US009453292B2

(12) United States Patent
Sommer et al.

(10) Patent No.: US 9,453,292 B2
(45) Date of Patent: Sep. 27, 2016

(54) METHOD AND APPARATUS FOR MAKING A SPUNBOND

(75) Inventors: Sebastian Sommer, Troisdorf (DE); Wilhelm Frey, Spich (DE)

(73) Assignee: REIFENHAEUSER GMBH & CO.KG MASCHINENFABRIK, Troisdorf (DE)

( * ) Notice: Subject to any disclaimer, the term of this patent is extended or adjusted under 35 U.S.C. 154(b) by 392 days.

(21) Appl. No.: 11/998,444

(22) Filed: Nov. 29, 2007

(65) Prior Publication Data

US 2009/0152757 A1 Jun. 18, 2009

(30) Foreign Application Priority Data

Dec. 6, 2006 (DE) ..... 06 025 192

(51) Int. Cl.
*D01F 6/62* (2006.01)
*D04H 3/16* (2006.01)
*D04H 3/14* (2012.01)

(52) U.S. Cl.
CPC . *D04H 3/16* (2013.01); *D04H 3/14* (2013.01)

(58) Field of Classification Search
CPC ..... D04H 3/16; D04H 3/14
USPC ..... 264/103
See application file for complete search history.

(56) References Cited

U.S. PATENT DOCUMENTS

| | | | | |
|---|---|---|---|---|
| 4,851,179 | A * | 7/1989 | Reifenhauser | D04H 3/16 156/167 |
| 5,297,667 | A * | 3/1994 | Hoffman et al. | 198/493 |
| 5,814,349 | A | 9/1998 | Geus | |
| 5,913,997 | A | 6/1999 | Schulz | |
| 6,881,375 | B2 * | 4/2005 | Topolkaraev et al. | 264/555 |
| 6,896,843 | B2 | 5/2005 | Topolkaraev | |
| 6,918,750 | B2 | 7/2005 | Geus | |
| 7,004,738 | B2 | 2/2006 | Becker | |
| 2003/0203162 | A1 | 10/2003 | Fenwick | |
| 2005/0026527 | A1 | 2/2005 | Schmidt | |
| 2005/0098256 | A1 * | 5/2005 | Polanco et al. | 156/167 |
| 2005/0245157 | A1 | 11/2005 | Kepner | |
| 2008/0210363 | A1 | 9/2008 | Sommer | |

* cited by examiner

*Primary Examiner* — Joseph S Del Sole
*Assistant Examiner* — John Robitaille
(74) *Attorney, Agent, or Firm* — Andrew Wilford

(57) ABSTRACT

A method of making a spunbond fleece from continuous filaments wherein at least some of the filaments produced have natural crimp. The filaments are deposited in the deposition station of a conveyor creating a filament mass and the conveyor transports the filament mass toward a consolidating device. A gas stream is produced that flows along the upper surface of the filament mass in the travel direction of the filament mass.

5 Claims, 3 Drawing Sheets

Fig.3
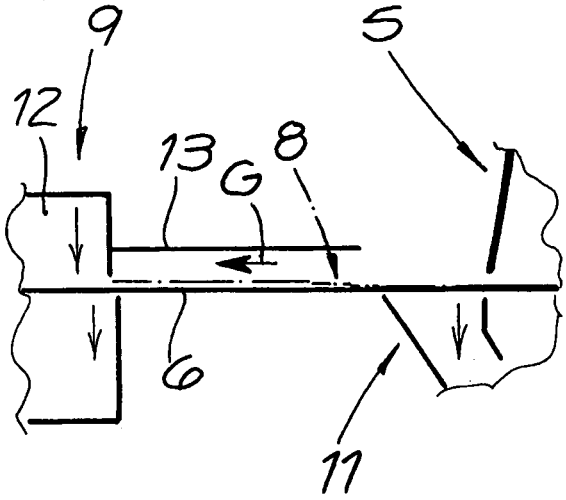
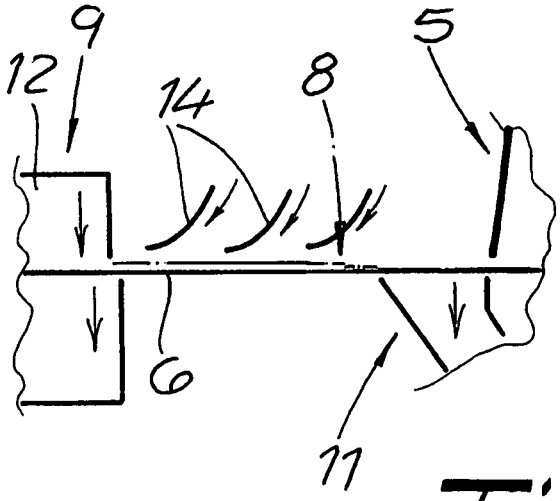
Fig.4

METHOD AND APPARATUS FOR MAKING A SPUNBOND

The invention relates to a method of making a spunbond fleece from continuous filaments. The invention also relates to an apparatus for performing such a method. It is within the framework of the invention that the continuous filaments comprise a thermoplastic material. Continuous filaments are distinguished by their nearly endless length from staple fibers that have significantly shorter lengths of for instance 10 to 60 mm. Normally the continuous filaments are produced with a spinning device or spinneret.

Basically known from practice is using staple fibers to produce voluminous fleeces that are known as "high loft fleeces." Fiber masses are normally consolidated by hot-air consolidation in a pass-through process. These fleeces are employed inter alia in the hygiene industry (for instance as separation layers in diapers) and in filters. There have already been attempts to produce fleeces with comparable thickness and volume from continuous filaments, where multicomponent filaments having natural crimp were used. However, as a rule what is obtained is filament mass or a spunbond fleece having an irregular or non-homogeneous structure. This is at least partially attributable to the fact that setting the crimp can lead to shrinking forces that can cause the filament mass or spunbond fleece to tear. The result is a less acceptable product.

In contrast, the technical problem of the instant invention is to provide a method of making a spunbond fleece from continuous filaments, with which method thick or voluminous spunbond fleeces having a very regular or homogeneous structure can be produced. In addition, another technical problem of the invention is to provide a corresponding apparatus.

For solving this technical problem, the invention teaches a method of making a spunbond fleece from continuous filaments wherein at least some of the filaments produced have natural crimp;

the filaments are deposited in the deposition station of a conveyor apparatus creating a filament mass and wherein the conveyor transports the filament mass toward a consolidating device; and a gas stream is produced that flows along the upper surface of the filament mass in the travel direction of the filament mass.

Basically in the framework of the invention single- or multi-ply fleeces can be produced that completely comprise filaments having natural crimp. However, it is also within the framework of the invention that a single-ply fleece is produced that has a mixture of filaments having natural crimp and filaments having no crimp. In the case of multi-ply fleeces, the individual plies can be made of filaments having natural crimp or filaments having no crimp or mixtures of filaments having natural crimp and filaments having no crimp. One inventive multi-ply fleece usefully has at least one ply (layer) that exclusively comprises filaments having natural crimp or a mixture of filaments having natural crimp and filaments having no crimp.

The continuous filaments are first spun from a spinning device or a spinneret. Then these filaments are effectively cooled. It is within the framework of the invention to stretch the filaments in a stretching unit. Cooling and stretching can also take place in particular in a combined cooling and stretching unit. The filaments are preferably conducted through a diffuser before they are deposited in the deposition station. The diffuser is here provided between the stretching unit or the combined cooling and stretching unit and the deposition station. The filaments exiting the spinning device are preferably treated in accordance with the Reicofil III method (DE-PS 196 20 379) [U.S. Pat. No. 5,814,349] or in accordance with the Reicofil IV method (EP-OS 1 340 843) [U.S. Pat. No. 6,918,750].

Filaments having natural crimp means in particular filaments or two- or multi-component filaments in which a crimp forms after stretching. That is, the crimp begins as soon as the stretching forces or the air stretching forces are no longer acting on the filaments. The crimping can take place first prior to deposition, i.e. between the stretching unit and the deposition station, in particular in a preferably provided diffuser. This crimp that occurs prior to deposition of the filaments is called "primary crimping." However, the filaments having natural crimp can also in particular develop a (secondary) crimp after depositing. This crimp that occurs after deposition is called "secondary crimping." In the framework of the invention, filaments having natural crimp preferably means filaments that after depositing on the conveyor when relaxed have a radius of curvature that is less than 5 mm. These filaments have corresponding crimp with the above-described radius of curvature across the majority of their length. In accordance with one very preferred embodiment of the invention the filaments having natural crimp are two-component or multicomponent filaments in a side-by-side arrangement. In accordance with another preferred embodiment, two-component or multicomponent filaments with an eccentric core/covering arrangement can be used for the filaments having natural crimp.

It is within the framework of the invention to carry out the inventive method such that crimping of the filaments (having natural crimp) takes place after stretching of the filaments and prior to deposition of the filaments. Thus, this is the above-described primary crimping of the filaments. It is furthermore within the framework of the invention that a crimping of the filaments (having natural crimp) also takes place after deposition of the filaments on the conveyor. This is the above-described secondary crimping.

The conveyor usefully comprises a conveyor belt or a plurality of successive conveyor belts. At least one conveyor belt is provided in the deposition station of the filaments as a gas-permeable (air-permeable) conveyor belt or gas-permeable (air-permeable) screen belt. Such a screen belt is in particular a continuous belt conducted via deflection rollers. In accordance with one particularly preferred embodiment of the invention, the filaments are deposited on a screen belt as the conveyor or as a component of a conveyor for creating the filament mass and the filament mass is subjected to suction air in a suctioning station of the screen belt. It is within the framework of the invention that the suctioning station includes the deposition station for the filaments and usefully also a station in the travel direction downstream of this deposition station. Preferably at least one suction device is provided below the screen belt for creating the suction air. Using such a suction device, air is suctioned through the screen belt so that the filaments or filament mass is so to speak suctioned onto screen belt. This results in a certain stabilization of the filament mass. Due to this suctioning, the filament mass has a relatively small thickness (for instance a thickness of approx. 2 to 3 mm). The filament mass is (still) fixed and held down on the screen belt in this suctioning station by a suction air field in order to withstand the relatively high air speeds in the deposition station without undesired displacement and nonhomogeneities. When it leaves the suctioning station, the filament mass springs back in particular due to the secondary crimping. Thereafter the filament mass has a significantly greater thickness (for instance a thickness of 3 cm at 40 g/m$^2$ square meter weight).

In accordance with the invention, a gas stream is produced that flows along the upper surface of the filament mass in the travel direction of the filament mass. That the gas stream flows along the upper surface of the filament mass means in particular that the gas stream flows parallel to or largely parallel to the upper surface of the filament mass or parallel to or largely parallel to the upper surface of the conveyor or screen belt. It is within the framework of the invention that the gas stream flows along the upper surface of the filament mass in the travel direction downstream of the suctioning station. The gas stream is preferably an air stream.

As stated in the foregoing, upon leaving the suctioning station the filament mass springs up so to speak in particular due to the secondary crimping and then the result is a relatively thick filament mass. The invention is based on the understanding that this filament mass is in jeopardy as it springs up and after it has sprung up, and this is specifically first because shrinkage forces from the secondary crimping can destroy the uniformity of the filament mass and second because air forces act on the filament mass that has sprung up and can so to speak break apart this filament mass. These air forces result from the fact that the filament mass is moved at the speed of the conveyor or screen belt against stationary ambient air. The invention is based on the understanding that the filament mass can be effectively stabilized with respect to the above-described negative effects by the gas stream flowing along the upper surface of the filament mass in the travel direction. In other words, the filament mass is inventively stabilized in particular in the suction-free stations by a forced air stream.

It is within the framework of the invention that the flow speed of the gas stream (air stream) is equal to at least half the travel speed of the filament mass, preferably at least 80%, particularly preferred at least 90%, and very particularly preferred at least 95% of the travel speed of the filament mass. In accordance with one particularly preferred embodiment, the flow speed of the gas stream (air stream) is at least equal to the travel speed or approximately equal to the travel speed of the filament mass. In accordance with one variant of the invention, the flow speed of the gas stream (air stream) is somewhat greater than the travel speed of the filament mass, specifically preferably no more than 20%, particularly preferred no more than 15%, and very particularly preferred no more than 10% greater than the travel speed of the filament mass.

In accordance with one highly recommended embodiment that is particularly significant in the framework of the invention, the filament mass is consolidated with at least one fluid medium in the consolidating device, preferably with at least one hot fluid medium. It is within the framework of the invention that the hot fluid medium acts on the filament mass in the consolidating device such that the filament mass is pressed against the conveyor or against a gas-permeable screen belt. Usefully, the forces of the hot fluid medium exert transverse pressure against the upper surface of the filament mass. This presses the filament mass against the conveyor or screen belt. It is within the framework of the invention that the hot fluid medium flows through the filament mass and the gas-permeable screen belt. This consolidation preferably takes place in a consolidating chamber through which the conveyor or screen belt is guided with the filament mass. The consolidation is usefully hot-air consolidation. In the consolidating device the fluid medium preferably flows perpendicular to the upper surface of the filament mass and preferably from above onto the filament mass. It is within the framework of the invention that the filament mass is acted upon by the hot fluid medium, preferably across the upper surface (i.e. not just linearly) by the hot fluid medium.

In accordance with one very preferred embodiment of the invention, the gas stream that flows along the upper surface of the filament mass is produced by means of the fluid medium flowing in the consolidating device. In other words, the fluid medium flowing in the consolidating device (preferably the hot air flowing there) is the driving force for making the gas stream that flows along the upper surface of the filament mass. It is within the framework of the invention that the inventive gas stream that flows is at least largely produced by a Venturi effect.

In accordance with another preferred embodiment of the invention, gas is blown into and/or suctioned out of the suctioning station downstream of the suctioning station and is diverted to the gas stream flowing along the upper surface of the filament mass using at least one flow guide. The at least one flow guide is preferably a flow-guide plate or a curved flow-guide plate.

The subject matter of the invention is also an apparatus for making a spunbond fleece from continuous filaments having at some natural crimp, having at least one spinning device for making filaments and having one conveyor with a deposition station in which the filaments can be deposited to create a filament mass, and wherein furthermore a consolidating device is provided for consolidating the filaments and wherein at least one generating apparatus is present with which a gas stream can be produced that flows along the upper surface of the filament mass in the travel direction of the filament mass between the deposition station and the consolidating station. This inventive gas stream preferably flows along the upper surface of the filament mass, specifically up to the consolidating device, in the travel direction downstream of the suctioning station.

It is within the framework of the invention that a stretching unit for stretching the filaments is provided between the spinning device and the deposition station. It is furthermore within the framework of the invention that a cooling unit is provided between the spinning device and the stretching unit. In accordance with one embodiment, a combined cooling and stretching unit is used. In accordance with one particularly preferred embodiment of the invention, a diffuser for depositing the filaments is provided between the stretching unit and the deposition station. This diffuser is particularly significant in the framework of the invention. The diffuser usefully has diffuser walls that diverge toward the deposition station.

The invention is based on the understanding that it is possible using the inventive method and using the inventive apparatus to produce thick or voluminous spunbond fleeces that are nevertheless distinguished by homogenous properties and a homogeneous or uniform structure. As a result spunbond fleeces can be produced that have optimum properties and optimum quality. It should also be stressed that these spunbond fleeces with this thickness and homogeneity can be reproducibly produced. It should furthermore be emphasized that with respect to the significant advantages attained the inventive method can be performed with relatively low complexity and thus is associated with only relatively low costs. Existing apparatuses can be retrofitted with no problem with the inventive components.

The invention is explained in greater detail in the following using a drawing that shows just one embodiment.

FIG. 3 is a special embodiment of the subject matter of FIG. 2; and,

FIG. 4 is another embodiment of the subject matter of FIG. 2.

The figures show an apparatus for carrying out a method of making a spunbond fleece from continuous filaments, whereby filaments 1 are produced at least some of which have natural crimp. In accordance with one embodiment, the spunbond fleece can be a single-ply spunbond that comprises exclusively is comprised of filaments having natural crimp or a mixture of filaments having natural crimp and filaments having no crimp. The portion of filaments having natural crimp is preferably at least 20% by weight, preferably at least 30 wt. %. In the framework of the inventive method a multi-ply fleece can also be produced in which at least one ply has filaments having natural crimp (as described in the foregoing).

Figure 1:
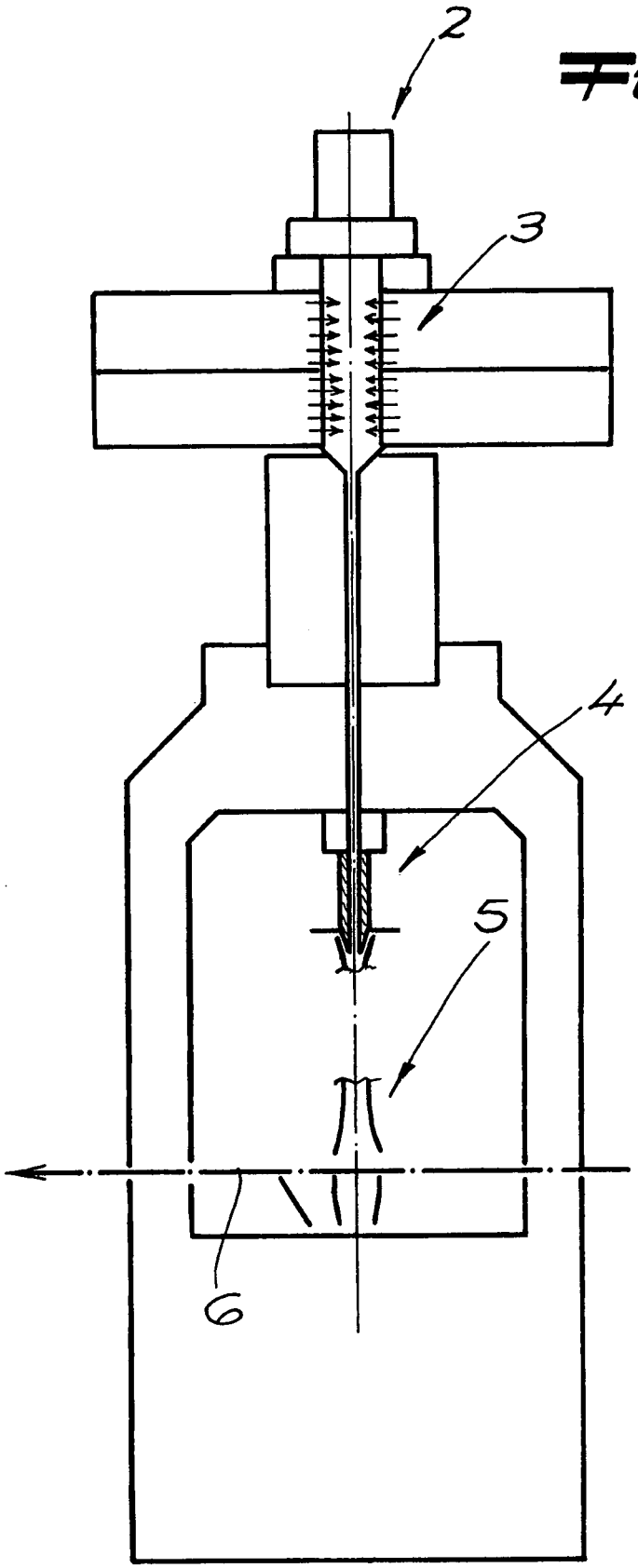
FIG. 1 is a section through a part of an inventive apparatus.
Figure 2:
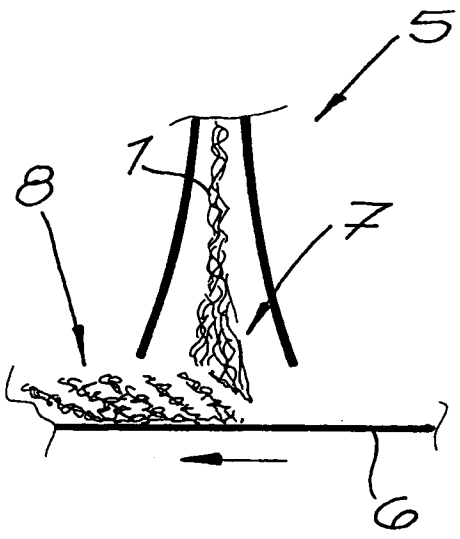
FIG. 2 is a section through another part of the inventive apparatus.
Figure 2:
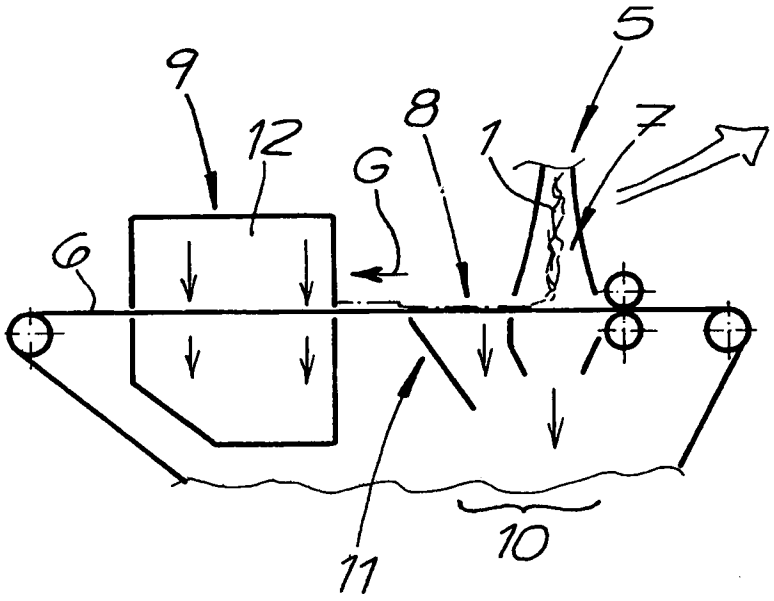

It can be seen from FIG. 1 that the inventive apparatus has a spinning device 2 for making the filaments 1 and a cooling chamber 3 that is downstream of the spinning device 2 and into which process air can be conducted for cooling the descending filaments 1. A stretching unit 4 is furthermore provided for stretching the filaments 1 aerodynamically. A diffuser 5 is preferably provided downstream of the stretching unit 4, merely indicated schematically in the illustrated embodiment. For instance, it is also possible to provide downstream of the stretching unit 4 a deposition unit made of two successive diffusers. Provided downstream of the diffuser 5 is a conveyor embodied as an air-permeable screen belt 6. The filaments 1 are deposited in a deposition station 7 of the screen belt 6 to create a filament mass 8. In the illustrated embodiment the filament mass 8 is formed from filaments 1 having natural crimp, the filaments 1 preferably being two-component filaments in a side-by-side arrangement. Downstream of or after the stretching unit 4 a first crimping (primary crimping) of these filaments takes place in the diffuser 5. In the figures the filament mass 8 is conveyed by the screen belt 6 to the left toward a consolidating device 9. The large-scale view of FIG. 2 shows that the filament mass 8 is shingled. Just deposited filaments 1 are atop the filaments 1 that have already been deposited and in this manner a shingled mass is created.

Suction acts upon the filament mass 8 in a suctioning station 10 of the screen belt 6. In other words, air is suctioned through the screen belt 6 preferably using a suction device (not shown) and the filaments 1 or the filament mass 8 is thereby also so to speak suctioned onto the screen belt 6. This causes a certain stabilization of the filament mass 8. The suctioning station 10 extends from the deposition station 7 for the filaments 1 into a station 11 provided downstream of the deposition station 7. Because of the action of the suction air, the filament mass 8 is fixed and held down on the screen belt 6 in this suctioning station 10 so that the filament mass 8 is relatively thin (for instance a thickness of 2 to 3 mm). When the filament mass 8 is conveyed further with the screen belt 6 and leaves the suctioning station 10, the filament mass 8 springs up in particular due to a further crimp (secondary crimping) and the result is a filament mass 8 having significantly greater thickness (for instance a thickness of approximately 3 cm). FIGS. 2 through 4 indicate this "springing up" with a corresponding increase in the thickness of the filament mass 8. Two disadvantageous effects in particular can be associated with the filament mass 8 springing up. First, shrinking forces from the secondary crimping can destroy the uniform structure of the filament mass 8. In addition, air forces can in effect pull apart the filament mass 7 because the filament mass 8 is moved at the speed of the screen belt against stationary ambient air. This pulling-apart can in particular occur due to the shingled nature of the mass showed in the enlargement in FIG. 2.

In accordance with the invention, a gas stream, which is indicated in the figures by an arrow G, is now produced in the station in which the filament mass 8 springs up or in the station of the secondary crimping and it flows in the travel direction of the filament mass 8 along the upper surface of the filament mass 8. This gas stream G flows along the upper surface of the filament mass 8 in the travel direction of the filament mass 8 downstream of the suctioning station 10. The invention is based on the understanding that the filament mass 8 that has sprung up can be stabilized by this inventive gas stream G and both of the above-described negative effects on the filament mass 8 can be counteracted in a functionally safe and reliable manner. The flow speed of the gas stream G is preferably at least equal to the travel speed of the filament mass 8 or to the screen belt speed or the flow speed of the gas stream G is somewhat greater than the travel speed of the filament mass 8 or is somewhat greater than the screen belt speed.

The screen belt 6 takes the filament mass 8 into a consolidating chamber 12 in which the filament mass 8 is preferably consolidated using a hot fluid medium or hot-air consolidating occurs. The hot fluid medium or the hot air flows from above perpendicular to the upper surface of the filament mass 8 onto the upper surface of the filament mass 8. This is indicated schematically by the corresponding arrows in FIGS. 2 through 4.

FIG. 3 shows one special embodiment for making an inventive gas stream G. In this case, a upper cover plate 13 is provided and the gas stream G flows between this cover plate 13 and the screen belt 6 or the upper surface of the filament mass 8 toward the consolidating device 9. The cover plate 13 is usefully provided parallel to or largely parallel to the screen belt 6 or the upper surface of the filament mass 8. In accordance with one preferred embodiment and in the illustrated embodiment in accordance with FIG. 3, the gas stream G flowing along the upper surface of the filament mass 8 is produced by means of the fluid medium flowing in the consolidating device 9. In other words, the fluid medium flowing in the consolidating chamber 12 drives the gas stream G.

FIG. 4 shows another preferred embodiment. In this case, air is blown from above into the station of the secondary crimping (station of the filament mass that has sprung up). Using appropriately curved flow-guide plates 14, gas blown in is diverted to form the gas streams G flowing along the upper surface of the filament mass 8. It is also possible to suction the gas stream.

Usefully and in the illustrated embodiment, the gas stream G flows perpendicular to or largely perpendicular to the direction of flow of the fluid medium in the consolidating device 9 or in the consolidating chamber 12. In accordance with one preferred embodiment and in the illustrated embodiment in accordance with the figures, only a single air-permeable screen belt 6 is provided that conveys the filament mass 8 from the deposition station 7 via the suctioning station 11 and via the station for the secondary crimping (station of the filament mass 8 that has sprung up) into the consolidating chamber 12. The screen belt 6 is guided in the normal manner as a continuous belt via corresponding deflection rollers.

Within the scope of the invention, one preferred embodiment that is showed schematically in FIG. 1 is particularly significant. According to it, apart from the air inlet of the cooling chamber 3 and apart from at least one air inlet in the station of the diffuser 5, the overall unit made of a cooling chamber 3, stretching unit 4, and diffuser 5, is embodied as a closed system. In other words, apart from the air supply in the cooling chamber 3, the overall unit made of cooling chamber 3 and stretching unit is closed. This closed embodiment of the apparatus has particularly proved itself with respect to optimum spunbond fleece quality, specifically in particular in combination with the other inventive features claimed herein.

The invention claimed is:

1. A method of making a spunbond fleece, the method comprising the steps of:

a) spinning continuous filaments at least some of which have natural crimp;

b) cooling and stretching the spun continuous filaments in a combined cooling and stretching unit with air drawn in through an air inlet;

c) excluding entry of air into the combined cooling and stretching unit except through the air inlet;

d) crimping the cooled and stretched continuous filaments in a diffuser downstream of the combined cooling and stretching unit as a primary crimping while passing the cooled and stretched continuous filaments downward between downwardly diverging walls of the diffuser;

e) depositing the cooled, stretched, and crimped continuous filaments after exiting the diffuser in an underlying deposition station as a filament mass onto a foraminous conveyor surface moving below the diffuser in a horizontal travel direction at a travel speed;

f) sucking air downward through the conveyor surface in a suctioning station at and downstream of the deposition station to retain the mass on the conveyor surface and to vertically compress the mass;

g) transporting the mass with the conveyor surface in the direction at the travel speed from the suctioning station to a consolidation station such that upon leaving the suctioning station and before entering the consolidation station at least the filaments with natural crimp undergo secondary crimping and the mass springs up;

h) blowing or suctioning a gas stream down onto the mass downstream of the diffuser and upstream of the consolidation station;

i) redirecting the gas stream into movement in the direction as and along the mass on the conveyor surface between the deposition station and the consolidation station, parallel to an upper surface of the mass, and at a speed greater than the travel speed of the surface and equal at most to 20% more than the travel speed of the surface so as to stabilize the secondarily crimped filaments; and j) consolidating the mass in the consolidation station.

2. The method defined in claim 1 wherein the filaments are formed of more than one component.

3. The method defined in claim 1 wherein the consolidation of step j) is carried out by passing a heated fluid medium vertically and transversely of the direction through the mass in the consolidation station.

4. The method defined in claim 1, further comprising the step of:

k) blocking gas entry into the consolidation station such that the passage of the heated fluid medium transversely through the mass creates a venturi effect that creates the gas stream traveling in the direction along the mass.

5. The method defined in claim 4 wherein gas entry is blocked in step k) by generally closing the consolidation station except at an entrance slot open upstream in the direction and through which substantially only the conveyor surface, the mass, and the gas stream enter the consolidation station.

* * * * *